US012798920B2

(12) United States Patent
Ando

(10) Patent No.: US 12,798,920 B2
(45) Date of Patent: Nov. 17, 2026

(54) SHEET POSTPROCESSING DEVICE

(71) Applicant: KYOCERA Document Solutions Inc., Osaka (JP)

(72) Inventor: Yoshihiro Ando, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 114 days.

(21) Appl. No.: 18/975,757

(22) Filed: Dec. 10, 2024

(65) Prior Publication Data

US 2025/0197157 A1 Jun. 19, 2025

(30) Foreign Application Priority Data

Dec. 18, 2023 (JP) ..... 2023-212924

(51) Int. Cl.
*B65H 37/04* (2006.01)

(52) U.S. Cl.
CPC ..... *B65H 37/04* (2013.01); *B65H 2801/27* (2013.01)

(58) Field of Classification Search
CPC .... B42C 1/12; B65H 37/04; B65H 2408/122; B65H 2408/1222; G03G 15/6541; G03G 15/6582; G03G 2215/00827; G03G 2215/00848
USPC ..... 270/58.08
See application file for complete search history.

(56) References Cited

U.S. PATENT DOCUMENTS 6,427,997 B1 8/2002 Hirota et al. ..... 270/58.12
8,087,654 B2 * 1/2012 Awano ..... G03G 15/6541 270/58.11
8,474,808 B2 * 7/2013 Matsuo ..... G03G 15/6544 270/58.08
8,977,186 B2 * 3/2015 Fukada ..... G03G 15/6541 399/407
10,654,305 B2 * 5/2020 Shimizu ..... B65H 31/3036
10,954,093 B2 * 3/2021 Susaki ..... B65H 37/04
2009/0179373 A1 7/2009 Awano et al. ..... 270/58.08
2011/0233842 A1 9/2011 Matsuo ..... 270/58.08

FOREIGN PATENT DOCUMENTS

JP 2001-031323 A 2/2001

OTHER PUBLICATIONS

Extended European Search Report dated May 12, 2025, issued by the European Patent Office in corresponding application EP 24219556.8.

* cited by examiner

*Primary Examiner* — Leslie A Nicholson, III
(74) *Attorney, Agent, or Firm* — Stein IP, LLC

(57) ABSTRACT

The stapling means drives stapler's staples into a bundle of sheets inserted into a sheet-insertion recessed portion. The moving plate is moved integrally with the stapling means in a sheet widthwise direction perpendicular to a sheet insertion direction in which the bundle of sheets is inserted into the sheet-insertion recessed portion. The base member supports the moving plate movably. The movement driving means makes the moving plate moved in the sheet widthwise direction. The sheet postprocessing device makes the stapling means moved via the moving plate by the movement driving means so as to drive the stapler's staples into the bundle of sheets, thus fulfilling stapling process. A center of gravity of the stapling means is positioned apart in the sheet insertion direction from a support point of the base member for the moving plate.

3 Claims, 3 Drawing Sheets

SHEET POSTPROCESSING DEVICE

INCORPORATION BY REFERENCE

This application is based on and claims the benefit of priority from Japanese Patent Application No. 2023-212924 filed on Dec. 18, 2023, the contents of which are hereby incorporated by reference.

BACKGROUND

The present disclosure relates to a sheet postprocessing device.

A conventional sheet postprocessing device includes a stapling means, a moving plate, a base member, and a movement driving means. The stapling means, having a sheet-insertion recessed portion for insertion of a bundle of sheets obtained by stacking of plural sheets, drives stapler's staples into a bundle of sheets inserted into the sheet-insertion recessed portion. The moving plate is moved integrally with the stapling means in a sheet widthwise direction perpendicular to a sheet insertion direction in which a bundle of sheets is inserted into the sheet-insertion recessed portion. The base member supports the moving plate movably. The movement driving means moves the moving plate in the sheet widthwise direction.

The stapling means is moved in the sheet widthwise direction via the moving plate by the movement driving means so that the stapler's staples are driven to specified positions of a bundle of sheets, thus allowing the stapling process to be achieved.

With the conventional art adopted, there has been a possibility that the moving plate, which is moved integrally with the stapling means, may strand on the base member, leading to occurrence of sheet-postprocessing failures. Also, when some members are provided to prevent the moving plate's strands, there has been another possibility that increase in parts count would cause manufacturing cost to increase.

The present disclosure having been achieved in view of the above-described problems, an object of the disclosure is to provide a sheet postprocessing device capable of suppressing occurrence of sheet-postprocessing failures while suppressing increases in manufacturing cost.

SUMMARY

In order to achieve the above object, a first configuration of the present disclosure is a sheet postprocessing device including a stapling means, a moving plate, a base member, and a movement driving means. The stapling means, having a sheet-insertion recessed portion into which a bundle of sheets obtained by execution of stacking process with plural sheets is to be inserted, drives stapler's staples into a bundle of sheets inserted into the sheet-insertion recessed portion. The moving plate is moved integrally with the stapling means in a sheet widthwise direction perpendicular to a sheet insertion direction in which the bundle of sheets is inserted into the sheet-insertion recessed portion. The base member supports the moving plate movably. The movement driving means makes the moving plate moved in the sheet widthwise direction. The sheet postprocessing device makes the stapling means moved via the moving plate by the movement driving means so as to drive the stapler's staples into the bundle of sheets, thus fulfilling stapling process. A center of gravity of the stapling means is positioned apart in the sheet insertion direction from a support point of the base member for the moving plate.

This and other objects of the present disclosure, and specific benefits obtained according to the present disclosure, will become more apparent from the description of embodiments which follows.

DETAILED DESCRIPTION

Figure 1:
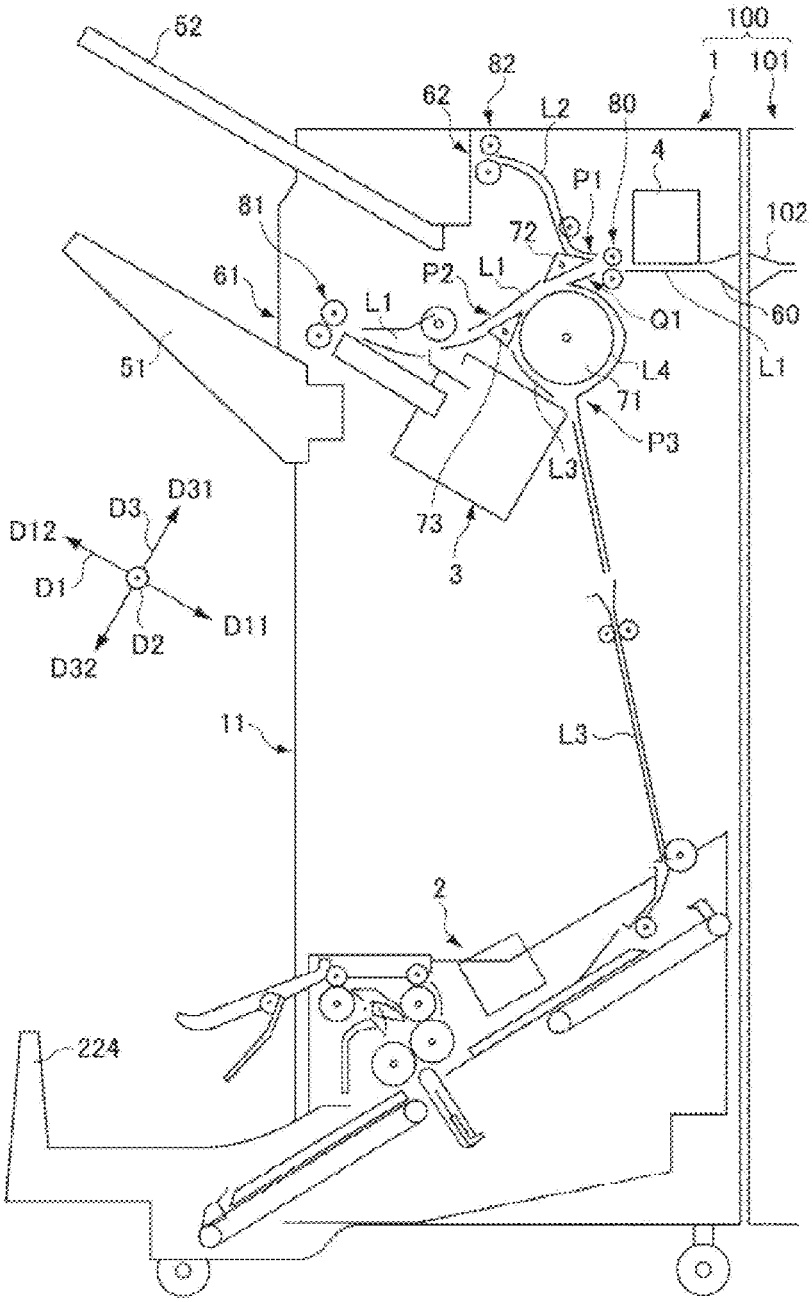
FIG. 1 is a schematic configuration of a sheet postprocessing device 1 according to an embodiment of the present disclosure.

Hereinafter, a multifunction peripheral 100 as an embodiment of an image forming apparatus according to the present disclosure will be described with reference to the accompanying drawings. FIG. 1 is a schematic sectional view for explaining outlines of a multifunction-peripheral main unit 101 and a sheet postprocessing device 1, from which the multifunction peripheral 100 as an embodiment of the disclosure is made up. As shown in FIG. 1, the multifunction peripheral 100 of this embodiment includes the multifunction-peripheral main unit 101 as an image-forming-apparatus main unit having an image forming part (not shown) for forming images on sheets, and also includes the sheet postprocessing device 1.

The multifunction-peripheral main unit 101 includes an image forming part (not shown) for forming an image on a sheet of paper or the like, and a main-unit discharge portion 102 for discharging a sheet with an image formed (printed) thereon by the image forming part to the sheet postprocessing device 1 or the like.

As shown in FIG. 1, the sheet postprocessing device 1 carries a sheet T, on which an image has been formed in the multifunction-peripheral main unit 101 and which has been discharged from the multifunction-peripheral main unit 101, inward of a housing 11 of the sheet postprocessing device 1 through a carry-in portion 60 provided at an upper portion of a right-side face of the sheet postprocessing device 1. Then, the carried-in sheet T is subjected to specified postprocessing such as stapling process and folding process.

The sheet postprocessing device 1 includes a sheet folding processing unit 2, a stapling processing unit 3, a punching portion 4, a main discharge tray 51, and a sub discharge tray 52. Also, the sheet postprocessing device 1 further includes a carry-in portion 60, a first conveyance path L1, a second conveyance path L2, a third conveyance path L3, a first branch portion P1, a second branch portion P2, a third branch portion P3, a first merging portion Q1, a main discharge portion 61, a sub discharge portion 62, a retractable drum 71, various switching members, and various rollers and roller pairs.

First, a configuration related to conveyance of a sheet T is described. The carry-in portion 60 is a site at which the sheet T discharged from the main-unit discharge portion 102 of the multifunction-peripheral main unit 101 is carried inward of the sheet postprocessing device 1. The first conveyance path L1 is for conveyance of the sheet T carried in through the carry-in portion 60 up to the main discharge portion 61.

The sheet T discharged from the main discharge portion 61 is discharged onto the main discharge tray 51.

The second conveyance path L2 branches at the first branch portion P1 from the first conveyance path L1. The second conveyance path L2 conveys the sheet T, which is under conveyance through the first branch portion P1, up to the sub discharge portion 62. The sheet T discharged from the sub discharge portion 62 is discharged onto the sub discharge tray 52.

The third conveyance path L3 branches at the second branch portion P2 from the first conveyance path L1, extending up to the sheet folding processing unit 2. The second branch portion P2 is positioned downstream of the first branch portion P1 in the first conveyance path L1. A fourth conveyance path L4, branching at the third branch portion P3 from the third conveyance path L3, is curved along a periphery of the retractable drum 71 so as to merge with the first conveyance path L1 at the first merging portion Q1. The first merging portion Q1 is positioned between the first branch portion P1 and the second branch portion P2 in the first conveyance path L1.

A first intermediate roller pair 80 is placed just before the first branch portion P1 in the first conveyance path L1. The first intermediate roller pair 80 feeds out the sheet T, which is conveyed just before the first branch portion P1 in the first conveyance path L1, toward the downstream side.

A first switching claw 72 provided at the first branch portion P1 functions to switch between conveyance destinations of the sheet T conveyed on the first conveyance path L1, that is, switch over whether the sheet T is let to remain going on the first conveyance path L1 as it is, or the sheet T is moved onto the second conveyance path L2. A second switching claw 73 provided at the second branch portion P2 functions to switch conveyance destinations of the sheet T conveyed on the first conveyance path L1, that is, switch over whether the sheet T is let to remain going on the first conveyance path L1 as it is, or the sheet T is moved onto the third conveyance path L3.

The punching portion 4 is placed in opposition to a region between the carry-in portion 60 and the first branch portion P1 in the first conveyance path L1. The punching portion 4 performs punching process on the sheet T at specified timing.

A main-discharge-portion roller pair 81 is placed at a site which is a terminal portion of the first conveyance path L1 and which is near the main discharge portion 61. The main-discharge-portion roller pair 81 feeds out the sheet T, which is under conveyance through the terminal portion of the first conveyance path L1, toward the main discharge tray 51. For feed-out of the sheet T to the stapling processing unit 3, the main-discharge-portion roller pair 81 cancels their nip, the paired rollers going apart from each other. Then, the sheet is fed out to the stapling processing unit 3 by an unshown sheet feed mechanism.

The main discharge tray 51 receives the sheet T discharged from the main discharge portion 61 by the main-discharge-portion roller pair 81. After having been subjected to stapling process chiefly in the stapling processing unit 3, a bundle of sheets T discharged from the main discharge portion 61 is received by the main discharge tray 51. The main discharge tray 51 is so arranged as to be moved in order downward from the uppermost position as the number of bundles of discharged sheets T increases more and more. Then, when the bundles of sheets T have been removed from on the main discharge tray 51, the main discharge tray 51 is returned to its reference position.

In addition, it is also allowable to receive, by the main discharge tray 51, such sheets T as are discharged without being subjected to any postprocessing in the sheet postprocessing device 1 or as have been subjected to only punching process.

A sub-discharge-portion roller pair 82 is placed at a site which is a terminal portion of the second conveyance path L2 and which is near the sub discharge portion 62. The sub-discharge-portion roller pair 82 feeds out the sheet T, which is under conveyance through the terminal portion of the second conveyance path L2, toward the sub discharge tray 52. The sub discharge tray 52 receives sheets T discharged from the sub discharge portion 62 by the sub-discharge-portion roller pair 82. The sub discharge tray 52 chiefly receives such sheets T as are discharged without being subjected to any postprocessing in the sheet postprocessing device 1 or as have been subjected to only punching process.

The sheet folding processing unit 2 is placed in lower part of the housing 11. The sheet folding processing unit 2 is located at a lowermost portion of the housing 11 of the sheet postprocessing device 1. The sheet folding processing unit 2 is provided downstream of the third conveyance path L3, and chiefly bundles of sheets T having been subjected to the stapling process are introduced therein. Therefore, the sheet folding processing unit 2 chiefly performs folding process for bundles of sheet T. When the folding process is selected by a user, the sheet folding processing unit 2 performs two-folding, three-folding or other folding process for bundles of sheets T, and discharges the bundles of sheets T to a lower discharge tray 224 provided in lower part of one side face of the housing 11 of the sheet postprocessing device 1.

The stapling processing unit 3 performs stacking process for stacking plural sheets T to form bundles of sheets T. The stapling processing unit 3 is enabled to execute various types of stapling process such as end-portion stapling for stapling an end portion of the stacked bundles of sheets T. For example, the end-portion stapling includes such processes as end-portion center stapling, which means two-point stapling applied to longitudinal two points near an end center of the bundles of sheets T, and end-portion diagonal stapling, which means one-point 45°-diagonal stapling applied to one end connector of the bundles of sheets T. Bundles of sheets T which have been subjected to the stacking process or end-portion stapling are discharged from the main discharge portion 61 by the main-discharge-portion roller pair 81.

With regard to the sheet T that has branched from the first conveyance path L1 and which is conveyed on the third conveyance path L3, the retractable drum 71 makes the sheet T conveyed onto the fourth conveyance path L4 so as to be circulated via the first conveyance path L1. As a result of this, the sheet T can be retracted temporarily. For successive execution of the stapling process with plural bundles of sheets T, the retractable drum 71 holds one sheet and some plural sheets out of a succeeding bundle of sheets T wound on the surface of the retractable drum 71, as in a standby state, while the preceding bundle of sheets T is under stapling process by the stapling processing unit 3. By this function of the retractable drum 71, it is no longer necessary to temporarily halt discharge of the sheets T from the multifunction-peripheral main unit 101 while the stapling process keeps underway, thus contributing to improvement of productivity.

Figure 2:
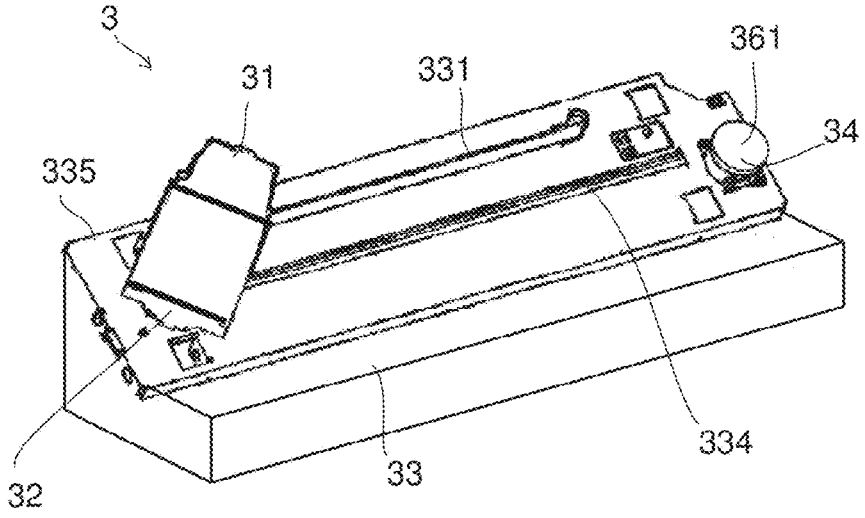
FIG. 2 is a perspective view of a stapling processing unit 3 in the sheet postprocessing device 1 according to the embodiment of the disclosure.
Figure 2:
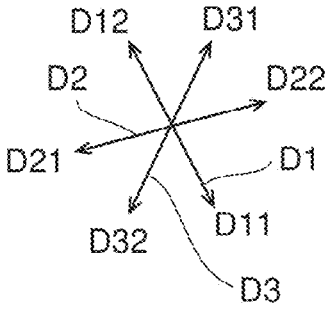
Figure 3:
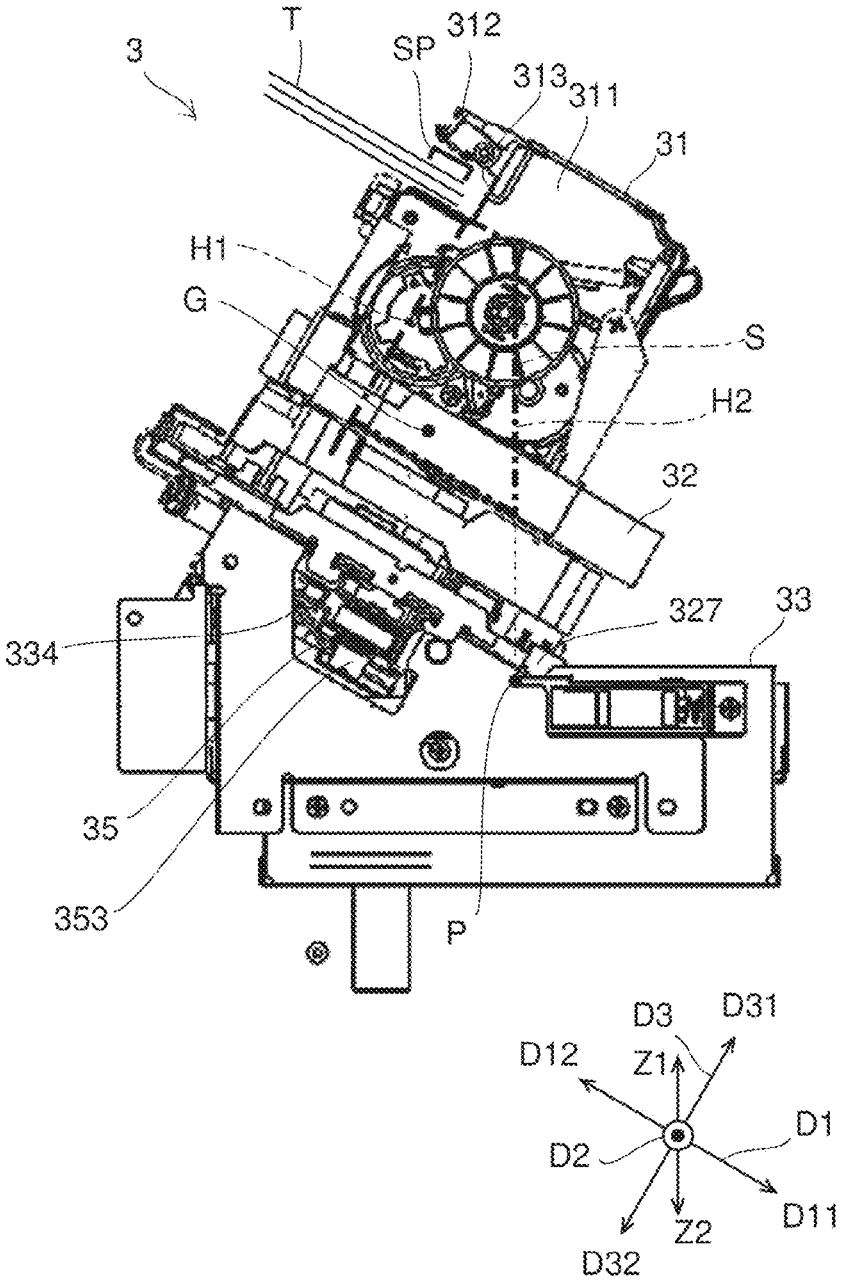
FIG. 3 is a side sectional view of the stapling processing unit 3 in the sheet postprocessing device 1 according to the embodiment of the disclosure.

Next, details of a structure of the stapling processing unit 3 in the sheet postprocessing device 1 of this embodiment will be described with reference to FIG. 2. FIG. 2 is a perspective view of the stapling processing unit 3, and FIG. 3 is a side sectional view of the stapling processing unit 3. The stapling processing unit 3 according to this embodiment is located in upper part of the housing 11 of the sheet postprocessing device 1. The stapling processing unit 3 is provided downstream of the first conveyance path L1. A bundle of sheets T obtained by subjecting plural sheets to stacking process is introduced into the stapling processing unit 3.

The stapling processing unit 3 moves the stapler (stapling means) 31 to drive the stapler's staples into the bundle of sheets T, thus fulfilling the stapling process. When stapling process is selected by the user, the stapling processing unit 3 executes the stapling process for the bundle of sheets T. The bundle of sheets T subjected to the stapling process is discharged onto the main discharge tray 51 provided in upper part of one side face of the housing 11 of the sheet postprocessing device 1.

Hereinafter, for convenience' sake, it is assumed that the term "sheet" includes a bundle of sheets T. Also, a direction in which the bundle of sheets T is inserted into a sheet-insertion recessed portion 313 of the stapling processing unit 3, or a direction in which the bundle of sheets T is conveyed from the sheet-insertion recessed portion 313, will be referred to as "sheet insertion direction D1". With regard to the sheet insertion direction D1, its direction of approaching the sheet-insertion recessed portion 313 is referred to as "insertion-downstream direction D11," and its direction of separating from the sheet-insertion recessed portion 313 is referred to as "insertion-upstream direction D12." The sheet insertion direction D1 is inclined against a vertical direction (up/down direction of sheet postprocessing device 1).

A direction perpendicular to the sheet insertion direction D1 will be referred to as "sheet widthwise direction D2." With regard to the sheet widthwise direction D2, its direction forward of the sheet postprocessing device 1 (nearer-to-viewer side in drawing sheet of FIG. 1) is referred to as "forward direction D21," and its direction backward of the sheet postprocessing device 1 (farther-from-viewer side in drawing sheet of FIG. 1) is referred to as "backward direction D22."

A direction perpendicular to both the sheet insertion direction D1 and the sheet widthwise direction D2 (i.e., a direction perpendicular to a D1-D2 plane) is referred to as "sheet thicknesswise direction D3." With regard to the sheet thicknesswise direction D3, its upward direction is referred to as "thicknesswise upward direction D31," and its downward direction is referred to as "thicknesswise downward direction D32."

The stapling processing unit 3 includes the stapler (stapling means) 31, a moving plate 32, a base member 33, and a movement driving means 34. That is, the sheet postprocessing device 1 includes the stapler (stapling means) 31, the moving plate 32, the base member 33, and the movement driving means 34.

The stapler (stapling means) 31 drives stapler's staples SP into a bundle of sheets T obtained by executing stacking process with plural sheets. Into the sheet-insertion recessed portion 313, a bundle of sheets T obtained by executing stacking process with plural sheets is inserted. The moving plate 32 is moved integrally with the stapler (stapling means) 31 in the sheet widthwise direction D2. The base member 33 supports the moving plate 32 movably. The movement driving means 34 moves the moving plate 32 in the sheet widthwise direction D2. A center of gravity of the stapling means is positioned apart in the sheet insertion direction from a support point of the base member for the moving plate.

The stapler (stapling means) 31 includes a stapler main body 311 with a clincher, a stitcher 312, and the sheet-insertion recessed portion 313. While a bundle of sheets T inserted into the sheet-insertion recessed portion 313 is set interveniently against the stitcher 312 and the clincher, the stapler 31 drives the stapler's staples into the bundle of sheets T. The stapler 31 in this embodiment is enabled to fulfill end-portion diagonal stapling process by driving the stapler's staples SP into the sheets T in a state that the stapler's staples SP are set in proximity to a corner portion of the bundle of sheets T while being inclined at a specified angle within the D1-D2 plane with respect to the sheet insertion direction D1 of the sheets T.

The base member 33 supports the moving plate 32 movably in the sheet widthwise direction D2. The base member 33 is formed primarily from a sheet-metal member. The base member 33 includes a generally rectangular-shaped main surface portion 335. The main surface portion 335 expands in the D1-D2 plane, being larger in length in the sheet widthwise direction D2 than in the sheet insertion direction D1.

The main surface portion 335 is inclined relative to the vertical direction (up/down direction of the sheet postprocessing device 1). The main surface portion 335 is provided with a guide groove 331 and a moving-purpose groove 334. The guide groove 331 and the moving-purpose groove 334 are grooves extending along the sheet widthwise direction D2, and the guide groove 331 is positioned farther in the insertion-upstream direction D12 than the moving-purpose groove 334. The moving-purpose groove 334 is positioned at a generally central portion of the main surface portion 335 in the sheet insertion direction D1. The moving-purpose groove 334 extends longer than the guide groove 331 in the sheet widthwise direction D2.

The moving plate 32 is a plate extending in the D1-D2 plane. The moving plate 32 has the stapler 31 mounted and held thereon. Relative to the base member 33, the moving plate 32 is moved linearly in the sheet widthwise direction D2 and integrally with the stapler 31. The moving plate 32 rotates around a virtual rotational axis extending in the sheet thicknesswise direction D3.

The moving plate 32 is provided with a pair of a wheel (not shown) and a wheel 327. The wheel (not shown) is placed on the insertion-upstream direction D12 side of the moving plate 32, apart therefrom in the sheet widthwise direction D2. The wheel 327 is placed on the insertion-downstream direction D11 side of the moving plate 32 and at a central portion in the sheet widthwise direction D2. The wheel (not shown) and the wheel 327 are rotatable relative to a base plate portion of the moving plate 32. The wheel (not shown) and the wheel 327 rotate in contact with an upper surface of the main surface portion 335 of the base member 33. As a result of this, the moving plate 32 is smoothly movable along the guide groove 331 in the main surface portion 335 of the base member 33.

In this case, load of the stapler 31 comes to a maximum at a contact point (support point P of the base member 33 for the moving plate) between the base member 33 and the wheel 327 placed closer to an end in the insertion-downstream direction D11. In this embodiment, the center of gravity G of the stapler 31 is positioned apart from the support point P in the sheet insertion direction D1.

More specifically, it is preferable that the center of gravity G of the stapler 31 be positioned in a region S as viewed in a cross section perpendicular to the sheet widthwise direction D2. The region S is a trapezoidal-shaped region surrounded by one-dot chain line in FIG. 3, i.e., surrounded by a first virtual line H1 and a second virtual line H2. The region S is positioned on one side Z2 vertically lower than a lower end of the sheet-insertion recessed portion 313. Also, the first virtual line H1 extends in the sheet thicknesswise direction D3 through the lower end of the sheet-insertion recessed portion 313. The second virtual line H2, passing through the support point P, extends in a vertical direction Z1. That is, the center of gravity G of the stapler 31 is positioned between the first virtual line H1 and the second virtual line H2.

The moving plate 32 makes a nip of the base member 33 against a first slider 35 via the moving-purpose groove 334 of the base member 33. The first slider 35 is freely movable under guide of the moving-purpose groove 334 along the direction in which the moving-purpose groove 334 extends.

The moving plate 32 also makes a nip of the base member 33 against a second slider (not shown) via the guide groove 331 of the base member 33. The second slider (not shown) is freely movable under guide of the guide groove 331 along the direction in which the guide groove 331 extends.

The first slider 35 has a wheel 353. The wheel 353 rotates in contact with a lower surface of the main surface portion 335 of the base member 33. As a result of this, the first slider 35 is smoothly movable along the moving-purpose groove 334 in the lower surface of the main surface portion 335 of the base member 33.

The second slider (not shown) has a wheel (not shown). The wheel (not shown) of the second slider rotates in contact with the lower surface of the main surface portion 335 of the base member 33. As a result of this, the second slider is smoothly movable along the guide groove 331 in the lower surface of the main surface portion 335 of the base member 33.

The movement driving means 34 is composed of a moving-plate linear movement driving means, a moving-plate rotation driving means, and a stapling-means inclination holding means. The moving-plate linear movement driving means moves the moving plate 32 linearly in the sheet widthwise direction D2. The moving-plate rotation driving means rotates the moving plate 32 in such fashion that the stapler 31 is inclined to a position that allows the stapler's staples SP to be driven with an inclination at a specified angle relative to the sheet insertion direction D1. The stapling-means inclination holding means mechanically holds the moving plate 32 so as to allow the stapler 31 to maintain its inclined state.

The movement driving means 34 has a motor 361. The motor 361 is a driving source for driving a pulley (not shown) into rotation via a shaft (not shown) or the like. The motor 361 is fixed on a depthwise direction D22 side in the upper surface of the main surface portion 335 of the base member 33, as an example.

The motor 361 serves as a driving source which moves the stapler 31 in the sheet widthwise direction D2 via a pulley, an endless belt, the moving plate 32, or the like, and moreover which rotates the stapler 31 around a virtual rotational axis extending in the sheet thicknesswise direction D3.

After the stapler 31 has been moved linearly in the sheet widthwise direction D2 by the movement driving means 34, the stapler 31 can be rotated. Then, with the stapler's staples SP inclined at a specified angle relative to the sheet insertion direction D1 and the sheet widthwise direction D2, the stapler 31 drives the stapler's staples SP into near a corner portion of the bundle of sheets T, thus fulfilling the end-portion diagonal stapling process.

In this process, the center of gravity G of the stapler 31 is positioned apart in the sheet insertion direction D1 from the support point P, so that a force thrusting the moving plate 32, which is moved integrally with the stapler 31, toward the base member 33 side acts at a fulcrum given by the support point P. As a result, the moving plate 32 can be prevented from stranding on the base member 33. Also, occurrence of sheet-postprocessing failures can be prevented only by changing the position of the center of gravity of the stapler 31, so that increase in manufacturing cost can be suppressed.

Furthermore, by virtue of the arrangement that the center of gravity G of the stapler 31 is placed between the first virtual line H1 and the second virtual line H2 and moreover placed on the vertically lower side Z2 lower than the lower end of the sheet-insertion recessed portion 313, the moving plate 32 can be prevented from stranding on the base member 33 to more extent.

The present disclosure is not limited to the above-described embodiment, and may be modified in various ways without departing from the scope of the appended claims. For example, individual configurations of the above embodiment may be partly omitted or combined arbitrarily with one another in ways other than described above. For example, although the above embodiment has been described on a sheet postprocessing device capable of end-portion diagonal stapling process, yet even a sheet postprocessing device capable of only parallel stapling process without involving rotation of the stapler 31 is also included in this disclosure.

The present disclosure is utilizable for image forming apparatuses including a sheet postprocessing device.

What is claimed is:

1. A sheet postprocessing device comprising:

a stapler having a sheet-insertion recessed portion into which a bundle of sheets obtained by execution of stacking process with plural sheets is to be inserted, the stapler being for driving stapler's staples into the bundle of sheets inserted into the sheet-insertion recessed portion;

a moving plate which is moved integrally with the stapler in a sheet widthwise direction perpendicular to a sheet insertion direction in which the bundle of sheets is inserted into the sheet-insertion recessed portion;

a base member for supporting the moving plate movably; and a motor fixed to the base member to serve as a driving source for moving the moving plate in the sheet widthwise direction via a pulley, wherein the sheet postprocessing device makes the stapler moved via the moving plate through driving of the motor so as to drive the stapler's staples into the bundle of sheets, thus fulfilling stapling process, the base member has a main surface portion inclined relative to a vertical direction, the moving plate has a wheel provided to be rotatable relative to a base plate portion, the wheel rotating while in contact with an upper surface of the main surface portion, the wheel being disposed at an end side in an insertion-downstream direction along the sheet insertion direction, and a center of gravity of the stapler is positioned closer to the main surface portion, apart in an insertion-upstream direction along the sheet insertion direction from a support point of the base member for the moving plate, the support point being a contact point between the wheel and the base member.

2. The sheet postprocessing device according to claim 1, wherein the center of gravity of the stapler is positioned between a first virtual line, which extends in a sheet thicknesswise direction passing through a lower end of the sheet-insertion recessed portion and perpendicular to the sheet insertion direction and the sheet widthwise direction, and a second virtual line, which extends in the vertical direction through the support point.

3. The sheet postprocessing device according to claim 1, wherein the center of gravity of the stapler is positioned on a vertically lower side lower than a lower end of the sheet-insertion recessed portion.

* * * * *